US007924303B2

(12) United States Patent
Yamaguchi et al.

(10) Patent No.: US 7,924,303 B2
(45) Date of Patent: Apr. 12, 2011

(54) LINE HEAD CONTROLLING METHOD AND IMAGE FORMING METHOD

(75) Inventors: Kenji Yamaguchi, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 179 days.

(21) Appl. No.: 12/357,194

(22) Filed: Jan. 21, 2009

(65) Prior Publication Data

US 2009/0189969 A1 Jul. 30, 2009

(30) Foreign Application Priority Data

Jan. 29, 2008 (JP) ..... 2008-017060
Nov. 4, 2008 (JP) ..... 2008-283022

(51) Int. Cl.
*B41J 2/45* (2006.01)

(52) U.S. Cl. ..... 347/238

(58) Field of Classification Search ..... 347/130, 347/233–235, 238, 248–250, 225, 229
See application file for complete search history.

(56) References Cited

U.S. PATENT DOCUMENTS

2008/0030566 A1* 2/2008 Nomura et al. ..... 347/130

FOREIGN PATENT DOCUMENTS

JP 05-261970 10/1993

* cited by examiner

*Primary Examiner* — Hai C Pham
(74) *Attorney, Agent, or Firm* — DLA Piper LLP (US)

(57) ABSTRACT

There is provided a method for controlling a line head including a focusing optical system, first light emitters, light from which being focused by the focusing optical system, second light emitters disposed next to the first light emitters in a first direction, light from the second light emitters being focused by the focusing optical system, and third light emitters disposed next to the second light emitters in the first direction, light from the third light emitters being focused by the focusing optical system. The method includes turning on the first light emitters at time t0, turning on the second light emitters after a period t1 has passed since the time t0, and turning on the third light emitters after a period t2 has passed since the time t0. The periods t1 and t2 are controlled under the following condition: $t2 \neq n \times t1$ (n is an integer two or greater).

7 Claims, 12 Drawing Sheets

LINE HEAD CONTROLLING METHOD AND IMAGE FORMING METHOD

CROSS REFERENCE TO RELATED ART

The disclosure of Japanese Patent Applications No. 2008-017060 filed on Jan. 29, 2008 and No. 2008-283022 filed on Nov. 4, 2008 including specification, drawings and claims is incorporated herein by reference in its entirety.

BACKGROUND

1. Technical Field

The present invention relates to a line head controlling method for correcting an exposure spot shift to prevent degradation in image quality, and an image forming method.

2. Related Art

There is an LED-based line head as an exposure light source of an image forming apparatus. JP-A-5-261970 proposes an inventive circuit that corrects an exposure spot shift in the direction in which a photoconductor rotates (secondary scan direction), the exposure spot shift caused by an LED line head having light emitters disposed in a staggered arrangement. In this inventive circuit, odd-numbered data and even-numbered data are separated and written in odd-numbered and even-numbered frame memories, respectively. In this process, the even-numbered and odd-numbered data are stored at different write addresses, the difference corresponding to the shift in row between an odd-numbered light emitter row and an even-numbered light emitter row. The data are then successively read from the frame memories in synchronization with a single strobe signal (in synchronization with a line data cycle). In this way, an exposure spot shift between an odd-numbered dot and an even-numbered dot is corrected on a basis of an integral multiple of the exposure spot diameter (the diameter of a single dot).

In the example described in JP-A-5-261970, the exposure spot shift cannot be corrected in some cases, for example, in an electrophotographic printer using an intermediate transfer belt. Such a case will be described below with reference to FIGS. 14A and 14B, descriptive diagrams showing related art of the invention. In FIG. 14A, reference numeral 10 denotes a line head. Reference numeral 41 denotes a photoconductor. Reference numeral 50 denotes an intermediate transfer belt that runs between a drive roller 51 and a driven roller 52 (transfer roller) and rotates in the direction indicated by the arrow R. Reference character P denotes a recording sheet that is fed in the direction indicated by the arrow S and on which a toner image is transferred at the position of the transfer roller 52. In a typical electrophotographic printer using an intermediate transfer belt, the ratio of the speed at which the photoconductor 41 rotates to the speed at which the intermediate transfer belt 50 rotates, that is, the speed at which the drive roller 51 rotates, is changed to adjust the tension of the intermediate transfer belt so that there is no cyclic stripes (banding) when the toner image is transferred onto the recording sheet P.

In this process, the ratio of the speed at which the photoconductor 41 rotates to the speed at which the intermediate transfer belt 50 rotates, that is, the speed at which the drive roller 51 rotates, causes expansion or shrinkage of the image in the secondary scan direction (the direction in which the photoconductor rotates). In this case, the dot-to-dot pitch in the image in the secondary scan direction (exposure spot pitch) is not an integral multiple of the exposure spot diameter (the diameter of a single dot), that is, a non-integral multiple of the exposure spot diameter. FIG. 14A shows a case where the photoconductor 41 rotates slowly, whereas the drive roller 51 rotates fast. In this case, the intermediate transfer belt 50 is held under tension. FIG. 14B shows a case where the photoconductor 41 rotates fast, whereas the drive roller 51 rotates slowly. In this case, the intermediate transfer belt 50 has a slack Rx in tension.

In such a case, since the configuration described in JP-A-5-261970 only allows the exposure spot shift to be corrected on a basis of an integral multiple of the exposure spot diameter (the diameter of a single dot), the correction is imprecise when the exposure spot pitch in the secondary scan direction is a non-integral multiple of the exposure spot diameter. For example, when a single linear latent image is formed in the axial direction (primary scan direction) of the photoconductor, the fact that the decimal part of the non-integral multiple cannot be fully corrected causes minute steps in the direction in which the photoconductor rotates (secondary scan direction). The image quality is therefore disadvantageously degraded.

Further, depending on the precision at which the line head is mounted on an apparatus body, the exposure spot pitch becomes a non-integral multiple of the diameter of the exposure spot formed on an image carrier some cases, resulting in a positional shift of the exposure spot. Such a case will be described below with reference to FIGS. 11A and 11B, descriptive diagrams showing related art of the invention. FIG. 11A shows a case where the precision at which the line head 10 is mounted on the apparatus body is insufficient, whereas FIG. 11B shows a case where the precision at which the line head 10 is mounted on the apparatus body is sufficient.

In FIG. 11A, reference numeral 2 denotes a light emitter provided on a substrate. Reference numeral 3 denotes a light emitter row formed of a plurality of light emitters arranged in the axial direction of the photoconductor. In the example shown in FIG. 11A, three light emitter rows A to C, each of which forms a light emitter array, are formed in the direction in which the photoconductor rotates. Reference character Ta denotes an inter-light-emitter-row pitch between the light emitter rows A and B. Now, let L1 be the distance between the light emitter rows A and B, and L2 be the distance between the light emitter rows B and C. The following equation is satisfied: $L2 \neq nL1$ (n is an integer greater than one). That is, the inter-light-emitter-row pitch is not an integral multiple of the exposure spot diameter (the diameter of a single dot), but a non-integral multiple of the exposure spot diameter. FIG. 11B shows a case where L2 is equal to L1 so that the inter-light-emitter-row pitch between the light emitter rows A and B is equal to the inter-light-emitter-row pitch between the light emitter rows B and C.

As described above, when the inter-light-emitter-row pitch in the secondary scan direction of the photoconductor is not fixed, the pitch between exposure spots formed on the photoconductor is not an integral multiple of the exposure spot diameter. Such a case will be described below with reference to FIGS. 12A and 12B and FIGS. 13A and 13B, descriptive diagrams showing related art of the invention. FIG. 12A shows a case where the pitch between exposure spots 4 formed on the photoconductor is an integral multiple of the exposure spot diameter ($W1=W2$). Reference characters Aa, Ba, and Ca denote exposure spot rows. In this case, as shown in FIG. 12B, a linear latent image Ea is formed in the axial direction (direction X) of the photoconductor. The direction Y is the direction in which the photoconductor rotates.

FIG. 13A shows a case where the pitch between exposure spots 4 is a non-integral multiple of the exposure spot diameter ($W2 \neq nW1$, n is an integer greater than one). In this case, when a single linear latent image is formed in the axial direction (direction X) of the photoconductor, the decimal part of the non-integral multiple cannot be fully corrected. Therefore, as shown in FIG. 13B, a formed latent image Eb has minute steps in the secondary scan direction (direction Y). In this case, the image quality is disadvantageously degraded.

SUMMARY

An advantage of some aspects of the invention is to provide a line head controlling method for correcting an exposure spot shift to improve image quality, and an image forming method.

A line head controlling method according to an aspect of the invention is provided to achieve the above object. The line head includes a focusing optical system, first light emitters, light from which being focused by the focusing optical system, second light emitters disposed next to the first light emitters in a first direction, light from the second light emitters being focused by the focusing optical system and, and third light emitters disposed next to the second light emitters in the first direction, light from the third light emitters being focused by the focusing optical system. The method includes turning on the first light emitters at time t0, turning on the second light emitters after a period t1 has passed since the time t0, and turning on the third light emitters after a period t2 has passed since the time t0. The periods t1 and t2 are controlled under the following condition: $t2 \neq n \times t1$ (n is an integer two or greater).

In the line head controlling method, it is preferable that the distance L1 between the first light emitters and the second light emitters in the first direction, and the distance L2 between the second light emitters and the third light emitters in the first direction satisfy the following equation: $L2 \neq n \times L1$ (n is an integer one or greater).

In the line head controlling method, it is preferable that first latent images formed by the first light emitters at the time t0 on a scanned surface that moves in the first direction, second latent images formed by the second light emitters after the period t1 has passed on the scanned surface that moves in the first direction, and third latent images formed by the third light emitters after the period t2 has passed on the scanned surface that moves in the first direction are formed in a second direction perpendicular to or substantially perpendicular to the first direction.

In the line head controlling method, it is preferable that the distance between the first latent images and the second latent images is a non-integral multiple of the width of any of the first latent images in the second direction.

In the line head controlling method, it is preferable that a second distance between the second latent images and the third latent images is a non-integral multiple of the width of any of the first latent images in the second direction.

In the line head controlling method, it is preferable that the focusing optical system has a negative optical magnification.

An image forming method according to another aspect of the invention includes providing a latent image carrier that moves in a first direction; providing an exposure head including a focusing optical system that is an erect optical system, first light emitters, light from which being focused by the focusing optical system, second light emitters disposed next to the first light emitters in the first direction, light from the second light emitters being focused by the focusing optical system, and third light emitters disposed next to the second light emitters in the first direction, light from the third light emitters being focused by the focusing optical system; turning on the first light emitters at time t0; turning on the second light emitters after a period t1 has passed since the time t0; and turning on the third light emitters after a period t2 has passed since the time t0. The periods t1 and t2 are controlled under the following condition: $t2 \neq n \times t1$ (n is an integer two or greater).

In the image forming method, it is preferable that the distance L1 between the first light emitters and the second light emitters in the first direction, and the distance L2 between the second light emitters and the third light emitters in the first direction satisfy the following equation: $L2 \neq n \times L1$ (n is an integer one or greater).

In the image forming method, it is preferable that first latent images formed by the first light emitters at the time t0 on the latent image carrier, second latent images formed by the second light emitters after the period t1 has passed on the latent image carrier, and third latent images formed by the third light emitters after the period t2 has passed on the latent image carrier are formed in a second direction perpendicular to or substantially perpendicular to the first direction.

In the image forming method, it is preferable that the distance between the first latent images and the second latent images in the first direction is a non-integral multiple of the width of any of the first latent images formed by the first light emitters on the latent image carrier in the second direction.

In the image forming method, it is preferable that a second distance between the second latent images and the third latent images in the first direction is a non-integral multiple of the width of any of the first latent images formed by the first light emitters on the latent image carrier in the second direction.

An image forming method according to another aspect of the invention includes providing a latent image carrier that moves in a first direction; providing an exposure head including a focusing optical system that is an inverted optical system, first light emitters, light from which being focused by the focusing optical system, second light emitters disposed next to the first light emitters in the first direction, light from the second light emitters being focused by the focusing optical system, and third light emitters disposed next to the second light emitters in the first direction, light from the third light emitters being focused by the focusing optical system; turning on the third light emitters at time t0; turning on the second light emitters after a period t1 has passed since the time t0; and turning on the first light emitters after a period t2 has passed since the time t0. The periods t1 and t2 are controlled under the following condition: $t2 \neq n \times t1$ (n is an integer two or greater).

In the image forming method, it is preferable that third latent images formed by the third light emitters at the time t0 on the latent image carrier, second latent images formed by the second light emitters after the period t1 has passed on the latent image carrier, and first latent images formed by the first light emitters after the period t2 has passed on the latent image carrier are formed in a second direction perpendicular to or substantially perpendicular to the first direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
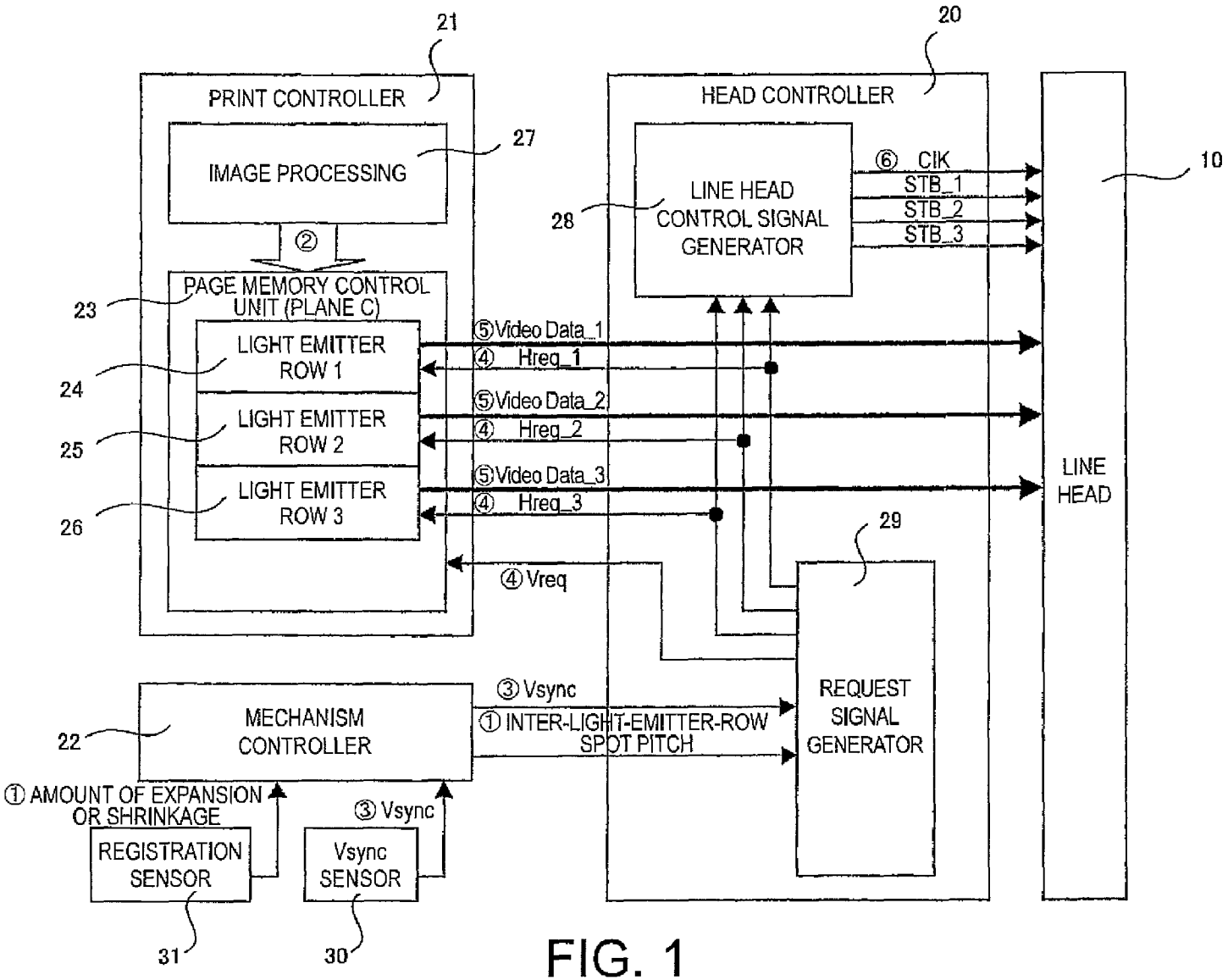
FIG. 1 is a block diagram showing an embodiment of the invention.

The invention will be described below with reference to the drawings. FIG. 1 is a block diagram of a control unit in an embodiment of the invention. In FIG. 1, to control a line head 10, a head controller 20, a print controller 21, and a mechanism controller 22 are provided. The print controller 21 includes an image processor 27, and the head controller 20 includes a line head control signal generator 28 and a request signal generator 29.

Figure 11A:
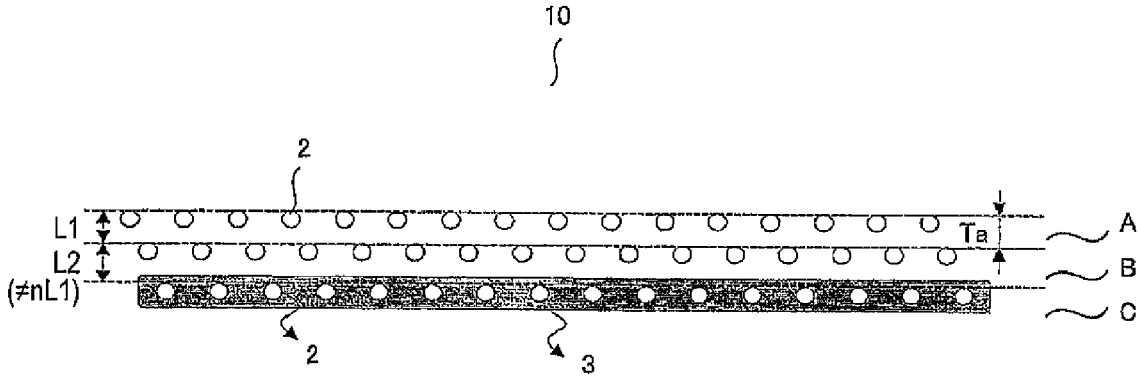
FIGS. 11A and 11B are descriptive diagrams showing related art of the invention.
Figure 11B:
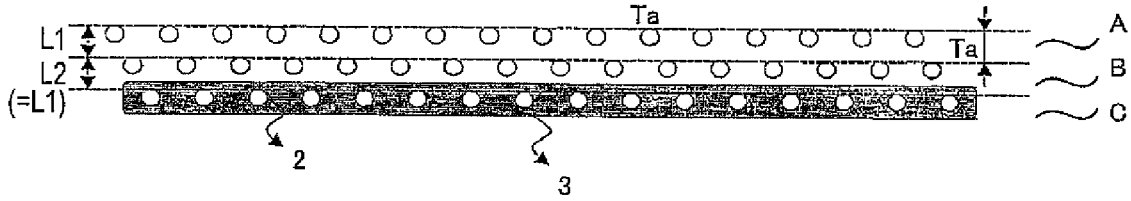

In FIG. 1, light emitters are configured in such a way that three light emitter rows (rows A, B, and C) are formed in the direction in which the photoconductor rotates (first direction), each of the light emitter rows having two or more light emitters arranged in the axial direction of the photoconductor (second direction), as described in FIGS. 11A and 11B. The light emitter rows are indicated as a light emitter row 1 to a light emitter row 3. In FIG. 1, although a page memory control unit 23 only showing a plane C is illustrated in the print controller 21, the same configuration applies to planes M, Y, and K. Memories 24 to 26 for the light emitter rows 1 to 3 are provided in the page memory control unit 23.

The control procedure shown in FIG. 1 will now be described. It is noted that encircled numerals are expressed, for example, as [1], for the reason of indication. When the printer starts, registration sensing is used to determine the amount of expansion or shrinkage of an image due to the ratio of the speed at which the photoconductor rotates to the speed at which the intermediate transfer belt rotates. First, a registration sensor 31, for example, a reflection-type photosensor, is used to read a printed registration mark to measure the amount of expansion or shrinkage (unit: μm) of an image. A CPU in the mechanism controller 22 uses the amount of expansion or shrinkage of the image to calculate the inter-light-emitter-row spot pitch and sends the result to the request signal generator 29 ([1]).

When printing is initiated, single-page image data undergoes image processing in the print controller 21, and the result is sent to the page memory control unit 23. The page memory control unit 23 separates the data that has undergone the image processing into those for the respective light emitter rows and stores them in the page memories. The separation of the data that has undergone the image processing into those for the respective light emitter rows is desirably carried out by a separation circuit or a CPU.

In the mechanism controller 22, a Vsync sensor 30 comprised of an optical sensor or any other suitable sensor detects a sheet end of a sheet to be printed and sends a video data synchronization signal (Vsync signal) to the request signal generator 29 in the head controller 20 ([3]).

The request signal generator 29 in the head controller 20 first receives the Vsync signal and generates a video data request signal (Vreq signal) to be sent to each of the planes ([4]). The request signal generator 29 then generates line data request signals (Hreq_1, Hreq_2, and Hreq_3) for the respective light emitter rows based on the inter-light-emitter-row spot pitch, and sends the signals to the page memory control unit 23 in the print controller 21 ([4]).

At the same time, the line data request signals for the respective light emitter rows are also sent to the line head control signal generator 28 ([4]) to synchronize drive circuits for the respective light emitter rows in the line head.

The page memory control unit 23 sends video data for the respective light emitter rows (VideoData_1, VideoData_2, and VideoData_3) to the line head 10 in synchronization with the line data request signals (Hreq_l, Hreq_2, and Hreq_3) ([5]). It is noted that pulse transmission timings of the line data request signals differ from one another in accordance with the amounts of exposure spot shift in the respective light emitter rows.

The difference in the pulse transmission timing allows the exposure spot shift to be corrected even when the inter-light-emitter-row spot pitch is a non-integral multiple of the exposure spot diameter (diameter of a single dot). The difference in the pulse transmission timing will be described later with reference to FIG. 3.

The line head control signal generator 28 generates a variety of signals (clock signal, strobe signal) for controlling the line head 10 and sends the signals to the line head 10 ([6]). It is noted that strobe signals (STB_1, STB_2, and STB_3) are synchronized with the line data request signals (Hreq_1, Hreq_2, and Hreq_3), respectively.

Figure 2:
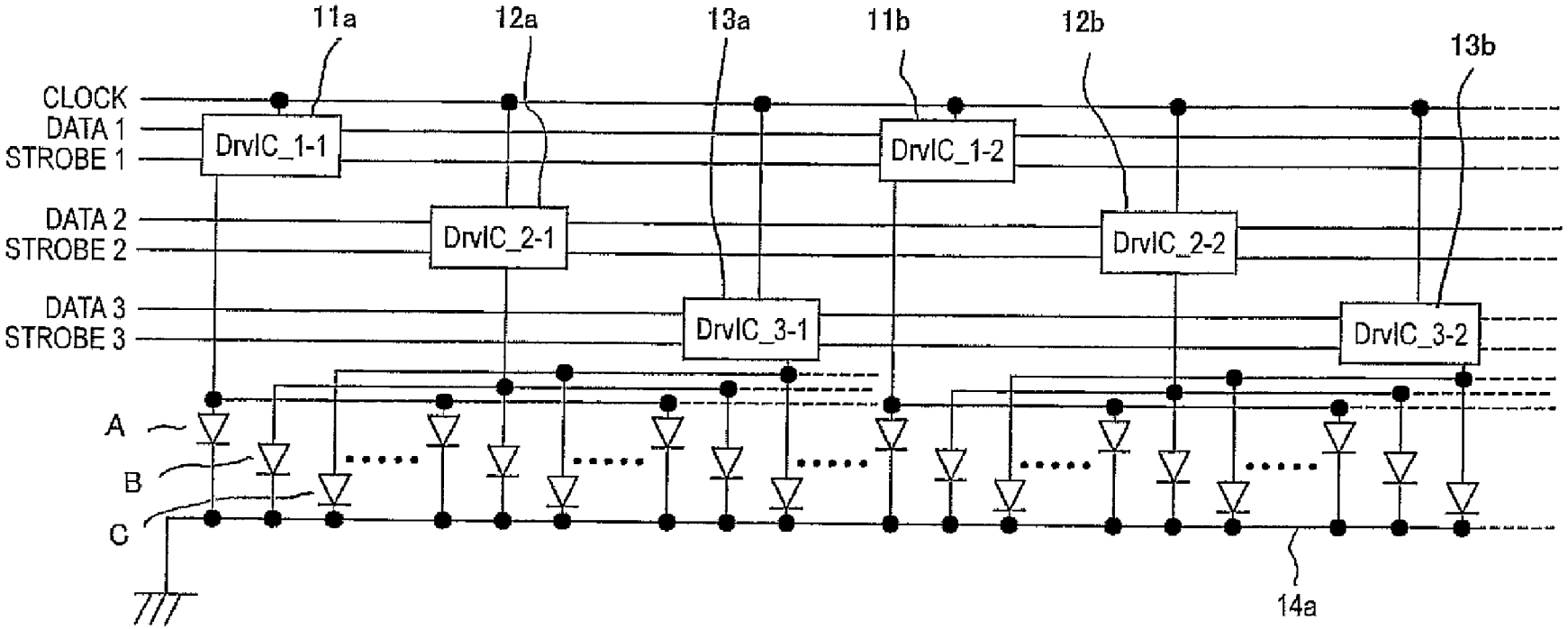
FIG. 2 is a circuit diagram showing an embodiment of the invention.

FIG. 2 is a circuit diagram showing the embodiment of the invention. In FIG. 2, the light emitters in the light emitter row A are controlled by drive circuits 11*a* and 11*b*. Drive circuits 12*a* and 12*b* control the light emitters in the light emitter row B, and drive circuits 13*a* and 13*b* control the light emitters in the light emitter row C. Reference character 14*a* denotes a power supply line.

The clock signal is supplied to all the drive circuits 11*a*, 11*b*, 12*a*, 12*b*, 13*a*, and 13*b*. Data signals 1 to 3 correspond to the video data (VideoData 1 to 3) in FIG. 1 and are supplied to the respective drive circuits 11*a* to 13*b*. The strobe signals 1 to 3 are also supplied to the respective drive circuits 11*a* to 13*b*.

Each of the strobe signals 1 to 3 defines the period during which light emitters emit light. In FIG. 2, using different strobe signals for different light emitter rows allows exposure timings for the different light emitter rows to be adjusted on a clock frequency basis. An exposure spot shift can therefore be corrected with high precision even when the inter-light-emitter-row spot pitch is a non-integral multiple of the exposure spot diameter (diameter of a single dot).

Figure 3:
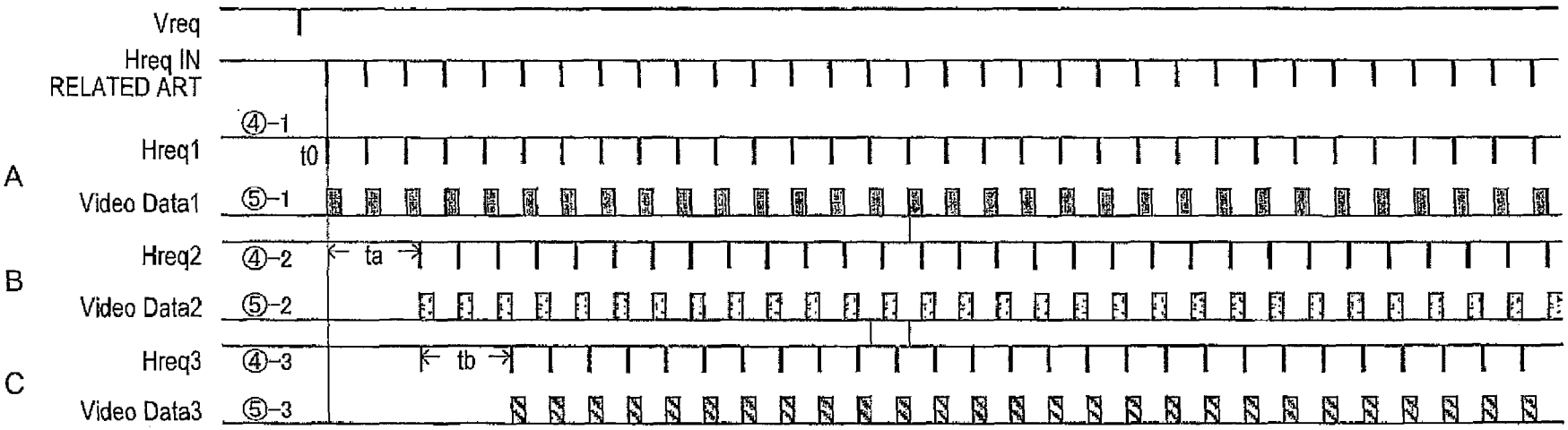
FIG. 3 is a timing chart showing an embodiment of the invention.

FIG. 3 shows a timing chart in the embodiment of the invention. The notation in FIG. 3, such as a signal [4]-1 and a signal [5]-1, corresponds to the notation in FIG. 1. That is, the signal [4]-1 indicates Hreq-1, and the signal [5]-1 indicates VideoData-1.

As described in FIG. 1, the request signal generator 29 outputs the video data synchronization signal Vreq. When a predetermined time has passed after the above output operation, the request signal generator 29 sends a line data synchronization signal Hsync to the line head control signal generator 28 to synchronize the line head drive circuits with a line data cycle (not illustrated in FIG. 3). Now, the timing when the Hsync signal is outputted is assumed to be a reference time. In FIG. 3, each of the Hreq signals is used as the reference time.

In FIG. 3, it is assumed that the timing when the first light emitter in the first light emitter row A is turned on at to, and that the timing when the first light emitter in the second light emitter row B is turned on after a period ta has passed since t0. It is then assumed that the timing when the first light emitter in the third light emitter row C is turned on after a period ta+tb has passed since t0. Since the light emitters in the light emitter row A to the light emitters in the light emitter row C form a single linear latent image, the spot pitch shift for each of the rows A to C in the direction Y (secondary scan direction) that corresponds to a predetermined dots needs to be corrected.

To this end, the line data synchronization signal is supplied at different timings for different light emitter rows to form a single latent image in the axial direction of the photoconductor. The different periods t1 and t2 are generally formulated as follows: t2≠n×t1 (n is an integer one or greater), where t1 is the period from the time t0 when the first light emitter row is turned on to the time when the second light emitter row is turned on, and t2 is the period from the time t0 when the first light emitter row is turned on to the time when the third light emitter row is turned on.

Figure 12A:
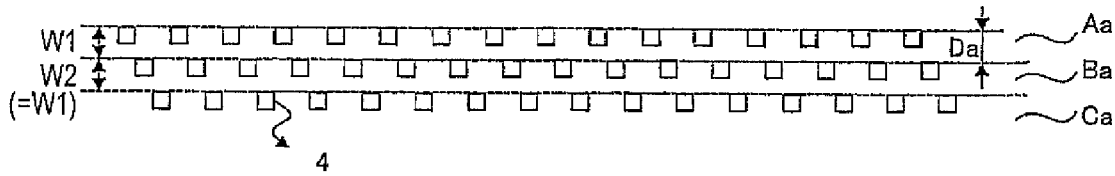
FIGS. 12A and 12B are descriptive diagrams showing related art of the invention.
Figure 12B:
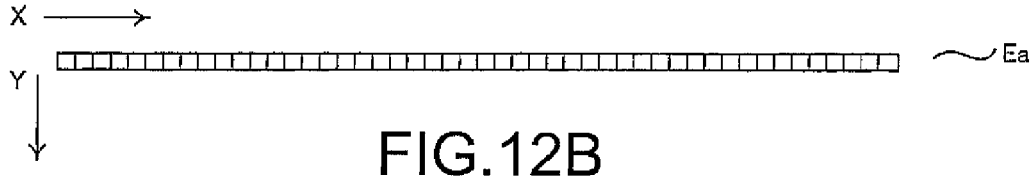
Figure 13A:
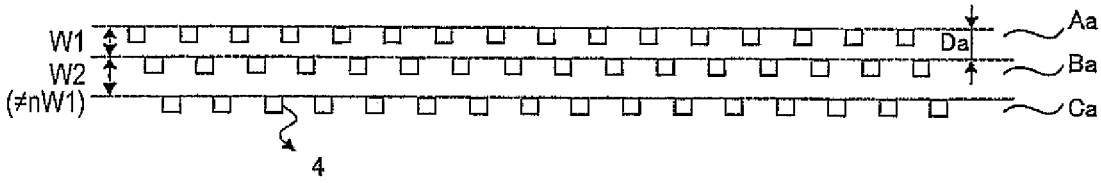
FIGS. 13A and 13B are descriptive diagrams showing related art of the invention.
Figure 13B:
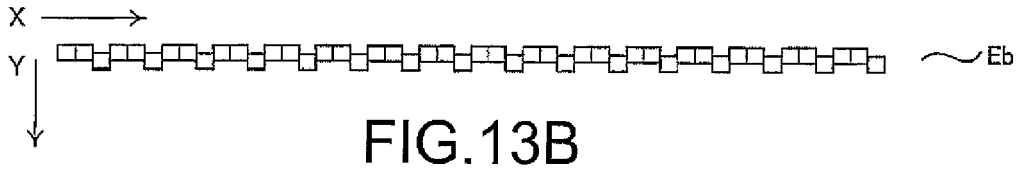
Figure 14A:
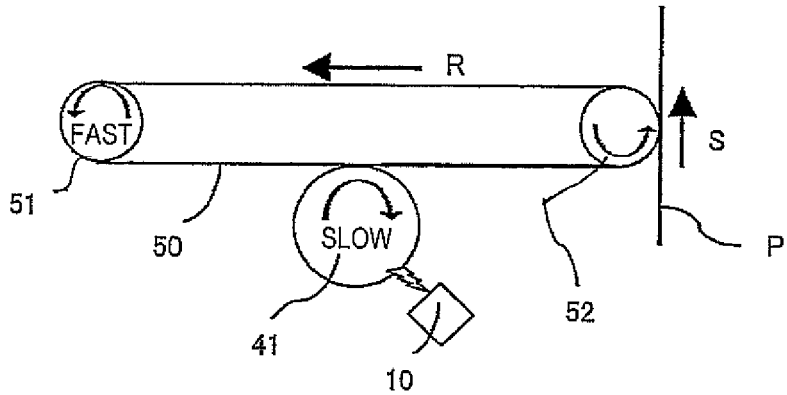
FIGS. 14A and 14B are descriptive diagrams showing related art of the invention.
Figure 14B:
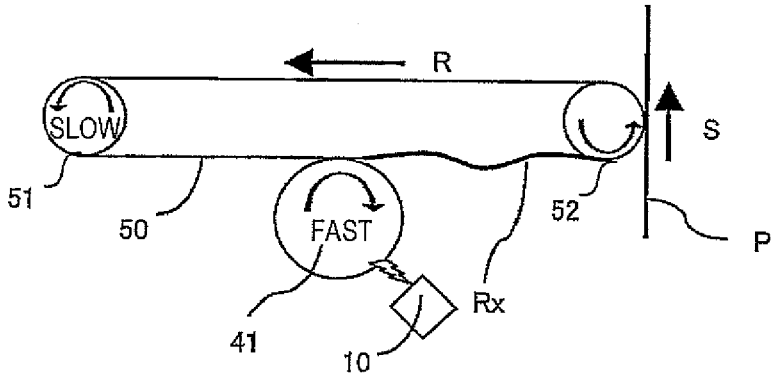

In general, the above equation t2≠n×t1 (n is an integer one or greater) is satisfied, where t1 is the period from the time when the m-th (m is an integer) light emitter row is turned on to the time when the (m+1)-th light emitter row is turned on, and t2 is the period from the time when the m-th light emitter row is turned on to the time when the (m+2)-th light emitter row is turned on. When the photoconductor rotates in a third direction that is opposite to the direction Y (first direction) shown in FIG. 12B, the above equation t2≠n×t1 (n is an integer one or greater) is satisfied, where t1 is the period from the time when the m-th (m is an integer) light emitter row is turned on to the time when the (m−1)-th light emitter row is turned on, and t2 is the period from the time when the m-th light emitter row is turned on to the time when the (m−2)-th light emitter row is turned on, Therefore, in the embodiment of the invention, an exposure spot shift in the direction in which the photoconductor rotates can be corrected with high precision when the exposure spot pitch in the direction in which the photoconductor rotates between a plurality of light emitter rows arranged in the direction in which the photoconductor rotates is a non-integral multiple of the exposure spot diameter (diameter of a single dot), whereby a high-quality image can be provided to a user.

As described in FIG. 11A, when the three light emitter rows A to C or more light emitter rows are arranged in the direction in which the photoconductor rotates (secondary scan direction) to form light emitter arrays that form latent images on the photoconductor in different positions for different light emitter rows, the embodiment of the invention is applicable even when the distances between the light emitter rows are different from one another. That is, in general, light emitter rows are arranged to satisfy L2≠n×L1 (n is an integer one or greater), where L1 is the distance from the h-th (h is an integer) light emitter row to the (h+1)-th light emitter row in the direction in which the photoconductor rotates, and L2 is the distance from the (h+1)-th light emitter row to the (h+2)-th light emitter row.

Figure 4:
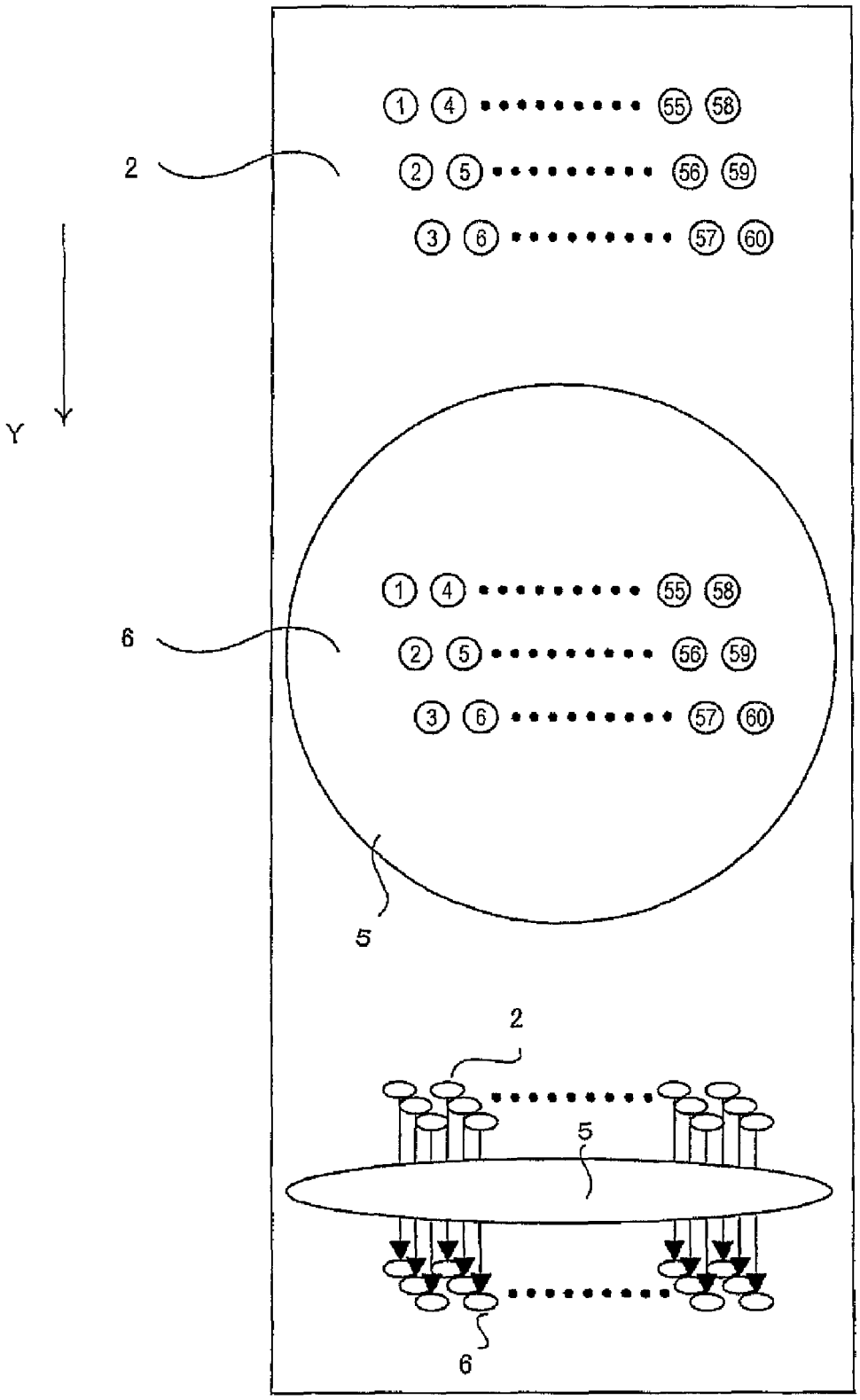
FIG. 4 is a descriptive diagram showing an embodiment of the invention.

In the embodiment of the invention, a lens having a negative optical magnification is used in some cases. Therefore, unlike a case where a lens having a positive optical magnification is used, data need to be sorted. Such a case will be described below. FIG. 4 is a descriptive diagram showing the relationship between the arrangement of light emitters and a latent image formed on the photoconductor when a lens having a positive optical magnification (erect optical system) is used.

In FIG. 4, reference numeral 2 denotes a light emitter, and light emitters [1] to [60] are arranged (encircled numerals are hereinafter expressed, for example, as [1] due to conversion reasons). Reference numeral 5 denotes a lens, and reference numeral 6 denotes a latent image. In this example, focused dots [1] to [60] in the latent image formed by the lens 5 on the photoconductor correspond to the light emitters [1] to [60]. Reference character Y denotes the direction in which the photoconductor rotates.

Figure 5:
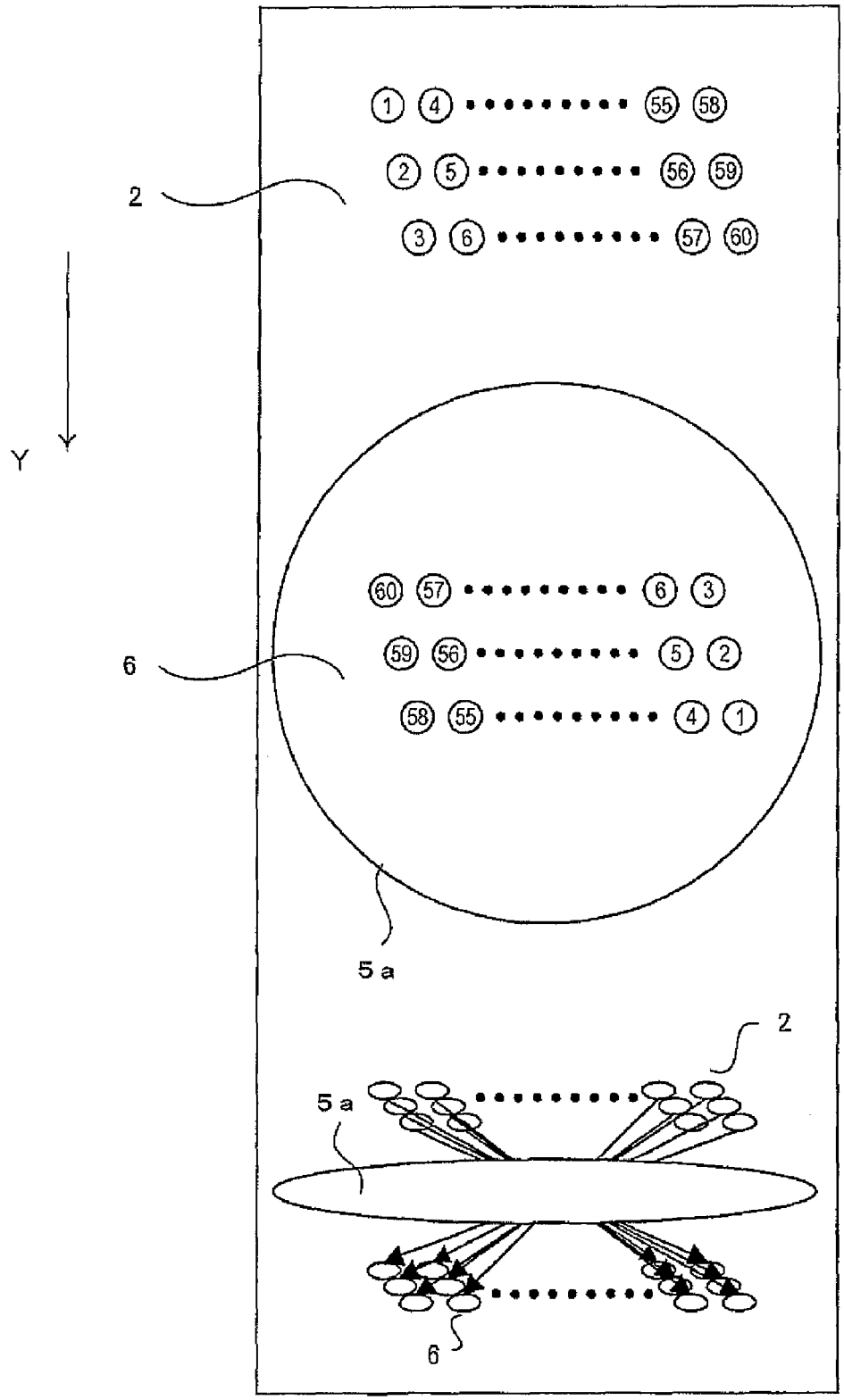
FIG. 5 is a descriptive diagram showing an embodiment of the invention.

FIG. 5 is a descriptive diagram showing a case where a lens having a negative optical magnification (inverted optical system) is used. In FIG. 5, light emitters 2 ([1] to [60]) are arranged, as in FIG. 4. A lens 5*a* having a negative optical magnification illuminates the photoconductor with the light emitted from the light emitters 2 but inverted both in the axial direction of the photoconductor and the direction in which the photoconductor rotates. The arrangement of focused dots [1] to [60] in a latent image 6 formed on the photoconductor is thus inverted from the arrangement of the light emitters 2 both in the axial direction of the photoconductor and the direction in which the photoconductor rotates. Therefore, when a latent image is formed on the photoconductor as in FIG. 4, data must be sorted by inverting the data both in the axial direction of the photoconductor and the direction in which the photoconductor rotates.

Figure 6:
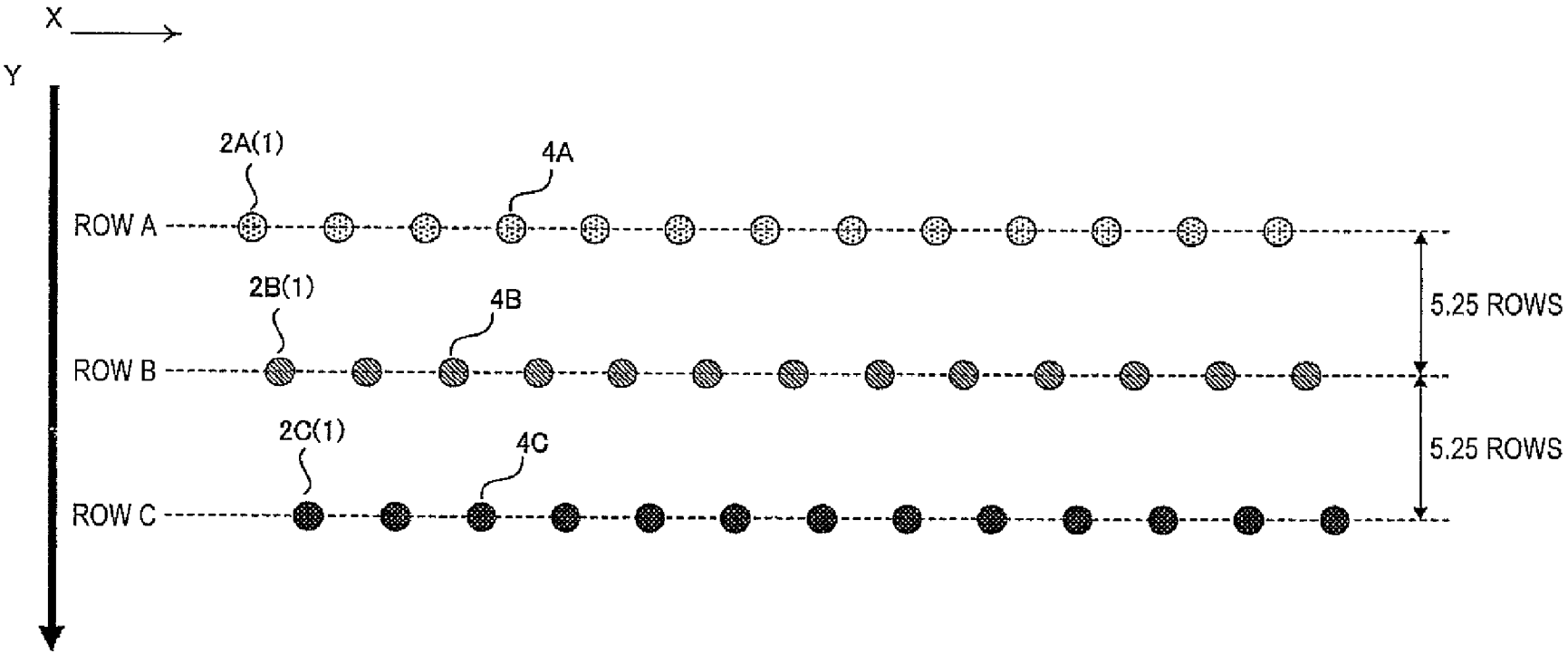
FIG. 6 is a descriptive diagram showing an embodiment of the invention.

FIG. 6 is a descriptive diagram showing another embodiment of the invention. In FIG. 6, three light emitter rows A, B, and C are arranged in the direction in which the photoconductor rotates (direction Y, first direction). Light emitters incorporated in the light emitter rows A, B, and C are disposed in such a way that the positions of the light emitters in one light emitter row are shifted from those of the light emitters in the other light emitter rows in the axial direction (direction X) of the photoconductor. For example, the position of the first light emitter 2A(1) in the light emitter row A when viewed in the axial direction of the photoconductor is shifted from the position of the first light emitter 2B(1) in the light emitter row B when viewed in the axial direction of the photoconductor. Further, the position of the first light emitter 2C(1) in the light emitter row C when viewed in the axial direction of the photoconductor is shifted from the positions of the light emitters 2A(1) and 2B(1).

In FIG. 6, the light emitters (first light emitters) in the first light emitter row A form first latent images 4A on the photoconductor (latent image carrier), which is a scanned surface. The photoconductor then moves in the first direction, and the light emitters (second light emitters) in the second light emitter row B form second latent images 4B on the photoconductor (latent image carrier), which is the scanned surface. The photoconductor further moves in the first direction, and the light emitters (third light emitters) in the third light emitter row C form third latent images 4C on the photoconductor (latent image carrier), which is the scanned surface.

The spot pitch (distance) between the latent images 4A and 4B formed on the photoconductor by the light emitter rows A and B is 5.25 times the spot diameter of any of the latent images formed by the first light emitters. That is, the spot pitch between the first latent images 4A and the second latent images 4B is a non-integral multiple of the spot diameter of any of the latent images formed on the image carrier by the light emitters in the first row. The spot pitch (distance) between the latent images 4B and 4C formed on the photoconductor by the light emitter rows B and C is 5.25 times the spot diameter of any of the latent images formed by the first light emitters. That is, the spot pitch between the second latent images 4B and the third latent images 4C is a non-integral multiple of the spot diameter of any of the latent images formed on the image carrier by the light emitters in the first row. It is noted that the spot diameter of any of the latent images is also referred to as the width in the second direction (direction X).

The spot pitch (distance) between the latent images 4A and 4C formed on the photoconductor by the light emitter rows A and C is 10.5 times the spot diameter of any of the latent images formed by the first light emitters. That is, the spot pitch between the first latent images 4A and the third latent images 4C can be considered to be a non-integral multiple of the spot diameter of any of the latent images formed on the image carrier by the light emitters in the first row. Although not illustrated in FIG. 6, the erect focusing optical system shown in FIG. 4 or the inverted focusing optical system shown in FIG. 5 can be provided for the light emitter rows A to C to focus the light from the light emitters on the photoconductor through the focusing optical system. In this case, the light emitters in the light emitter row A are also referred to as first light emitters. Similarly, the light emitters in the light emitter row B that are disposed next to the first light emitters in the first direction (direction Y) are also referred to as second light emitters, and the light emitters in the light emitter row C that are disposed next to the second light emitters in the first direction (direction Y) are also referred to as third light emitters.

Figures 7A, 7B, 7C, 7D, 7E, 7F, 7G:
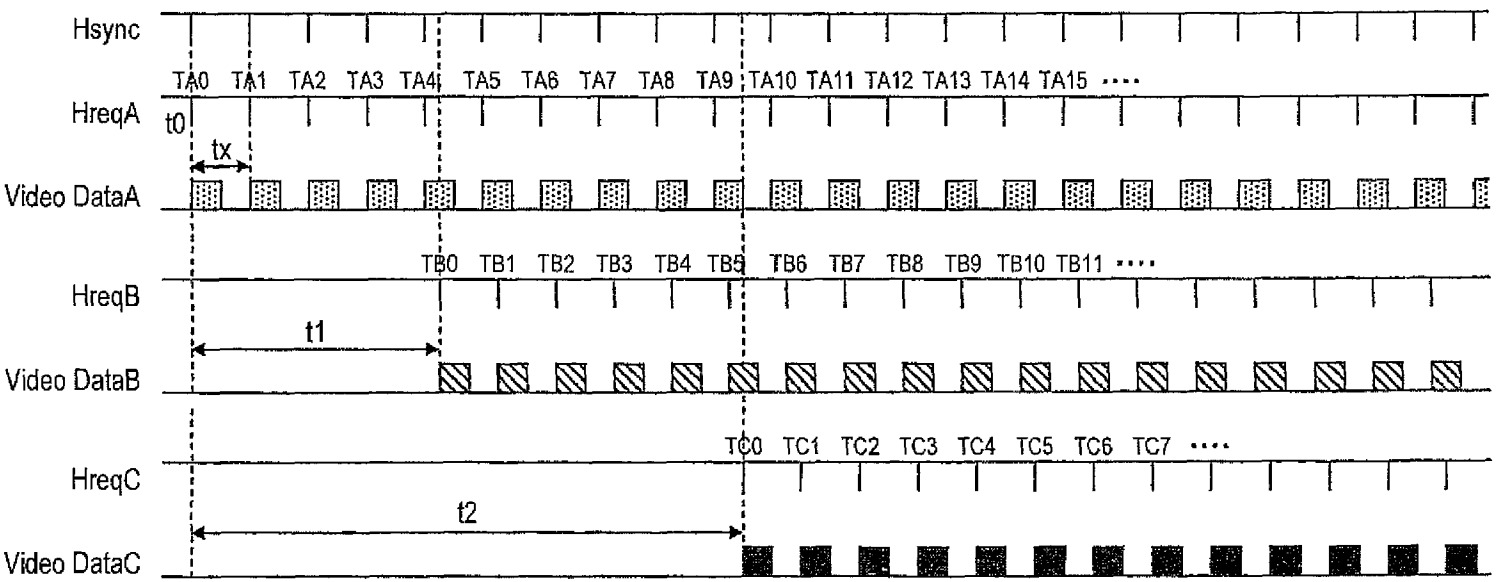
FIGS. 7A to 7G are timing chart showing an embodiment of the invention.

FIG. 7 is a timing chart based on which the light emitter rows A, B, and C shown in the example in FIG. 6 are controlled. In FIG. 7, reference characters (a) to (g) represent the following signals: (a) representing the Hsync signal, (b) representing an HreqA signal (the Hreq signal for the light emitter row A), (c) representing a Video DataA signal (the Video Data signal for the light emitter group row A), (d) representing an HreqB signal (the Hreq signal for the light emitter row B), (e) representing a Video DataB signal (the Video Data signal for the light emitter group row B), (f) representing an HreqC signal (the Hreq signal for the light emitter row C), and (g) representing a Video DataC signal (the Video Data signal for the light emitter group row C).

In (a) of FIG. 7, it is assumed that the timing when the light emitters in the first light emitter row A are turned on for the first time is to, and the timing when the light emitters are turned on next time is tx. The light emitters in the second row are turned on after a period t1 has passed since the time t0, and the light emitters in the third row are turned on after a period t2 has passed since the time t0. Reference characters TA0, TA1, . . . TA15, . . . represent timings when the line data request signal HreqA is sent to the light emitters in the light emitter row A. Reference characters TB0, TB1, . . . TB11, . . . represent timings when the line data request signal HreqB is sent to the light emitters in the light emitter row B. Reference characters TC0, TC1, . . . TC7, . . . represent timings when the line data request signal HreqC is sent to the light emitters in the light emitter row C. In this example, t1 is set in between TA4 and TA5, and t2 is set in between TA9 and TA11 and in between TB5 and TB6. In this description, it is assumed that the equation t2≠n×t1 (n is an integer two or greater) is satisfied. When the photoconductor rotates in the third direction that is opposite to the direction Y (first direction), the latent images 4A, 4B, and 4C in FIG. 6 are formed in the opposite order. Therefore, the signals in the timing chart shown in FIG. 7 are sent in the order of the light emitter rows C, B, and A (the light emitter row C is the first row. The light emitter row B is the second row. The light emitter row A is the third row).

Figures 8A, 8B, 8C, 8D, 8E, 8F, 8G, 8H:
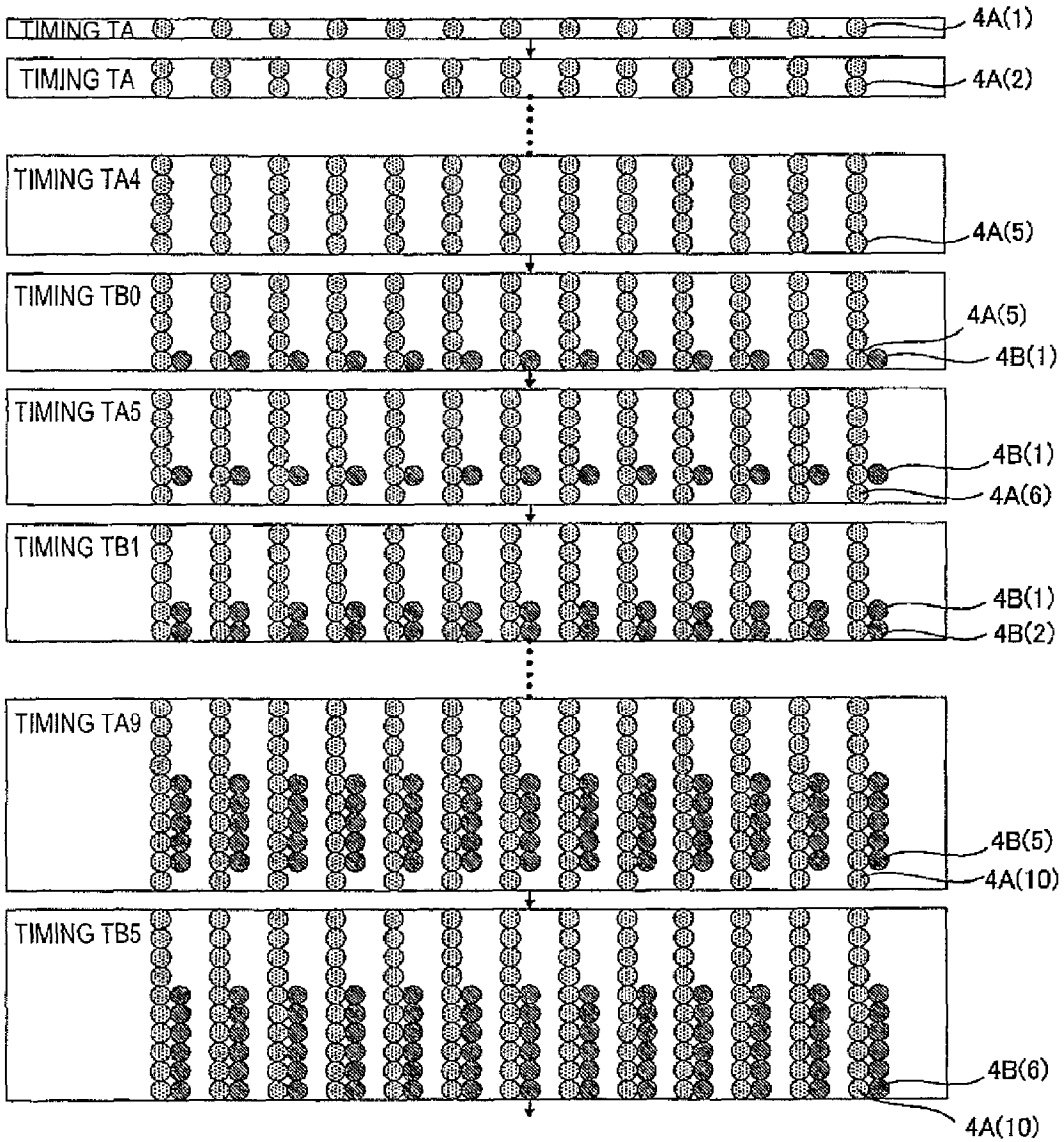
FIGS. 8A to 8H are descriptive diagrams showing an embodiment of the invention.

FIGS. 8A to 8H and 9I to 9L are descriptive diagrams showing examples of exposure spots formed on the photoconductor when the light emitters incorporated in the light emitter rows A, B, and C are turned on based on the timing chart shown in FIG. 7. FIG. 8A shows exposure spots 4A(1) formed on the photoconductor when the light emitters in the light emitter row A are turned on for the first time at the timing TA0 (time t0). FIG. 8B shows exposure spots 4A(2) formed on the photoconductor when the light emitters in the light emitter row A are turned on next time at the timing TA1 (time tx). The exposure spots 4A(1) correspond to the first latent images.

FIG. 8C shows exposure spots 4A(5) formed on the photoconductor when the light emitters in the light emitter row A are turned on at the timing TA4. Likewise, exposure spots are successively formed on the photoconductor. FIG. 8D shows exposure spots 4B(1) formed on the photoconductor when the light emitters in the light emitter row B are turned on at the timing TB0 (time t1). The exposure spots 4B(1) are formed next to one of the exposure spots 4A(1), 4A(2), . . . in the direction perpendicular to or substantially perpendicular to the direction Y (first direction). The exposure spots 4B(1) correspond to the second latent images. The spot pitch between the first latent images 4A(1) and the second latent images 4B(1) is a non-integral multiple of the spot diameter of any of the latent images formed on the scanned surface by the first light emitters in the light emitter row A described in FIG. 6.

As shown in FIG. 6, the positions where the light emitters in the light emitter row A are disposed are shifted from the positions where the light emitters in the light emitter row B are disposed in the axial direction of the photoconductor. Therefore, the exposure spots formed by the light emitters in the light emitter row B in the axial direction of the photoconductor are interleaved between the exposure spots formed by the light emitters in the light emitter row A in the axial direction of the photoconductor.

FIG. 8E shows exposure spots 4A(6) formed on the photoconductor when the light emitters in the light emitter row A are turned on at the timing TA5. FIG. 8F shows exposure spots 4B(2) formed on the photoconductor when the light emitters in the light emitter row B are turned on at the timing TB1. FIG. 8G shows exposure spots 4A(10), along with exposure spot 4B(5), formed on the photoconductor when the light emitters in the light emitter row A are turned on at the timing TA9. FIG. 8H shows exposure spots 4B(6) formed on the photoconductor when the light emitters in the light emitter row B are turned on at the timing TB5, along with the exposure spots 4A(10) formed by the light emitter row A described in FIG. 8G.

Figures 9I, 9J, 9K, 9L:
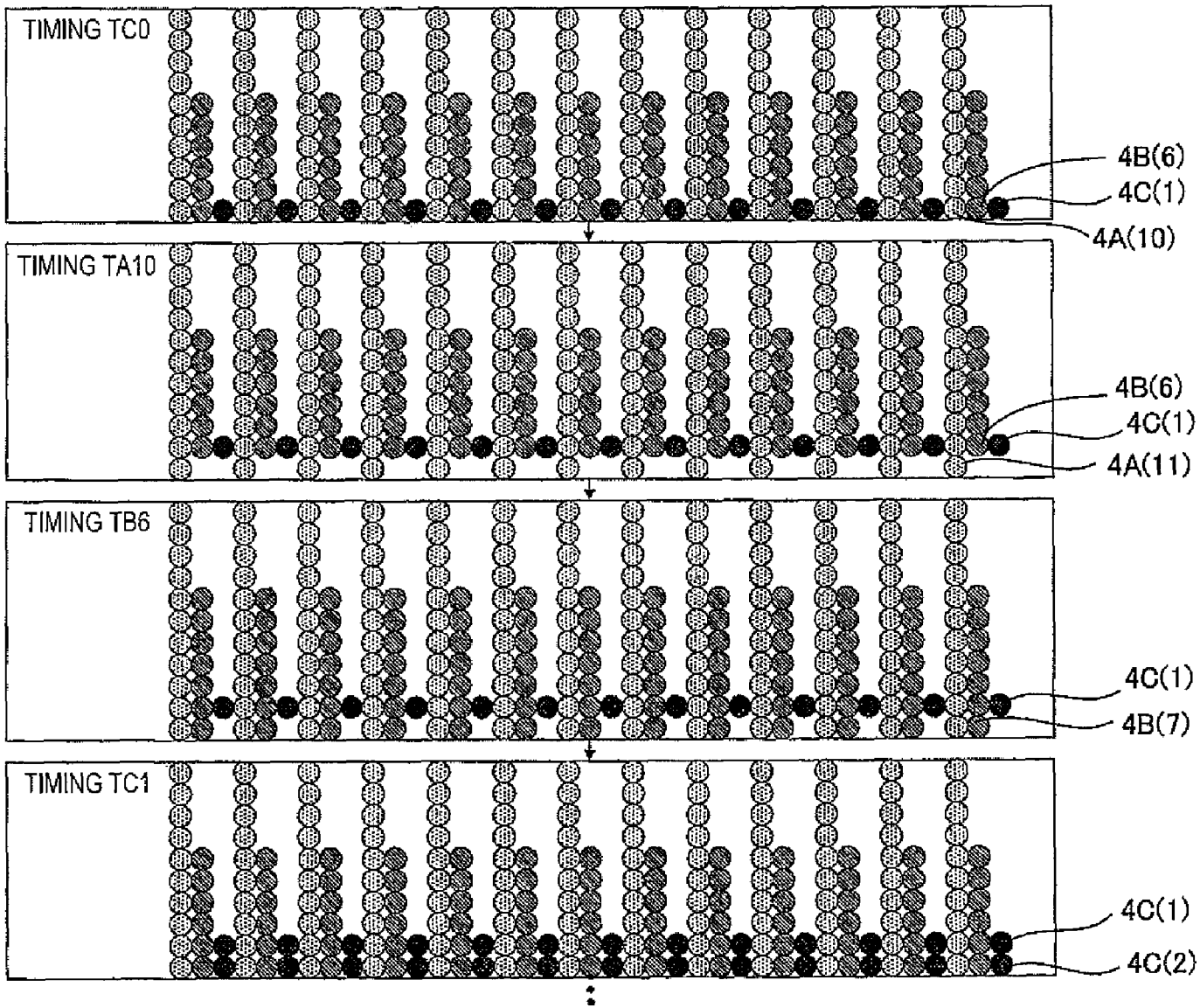
FIGS. 9I to 9L are descriptive diagrams showing an embodiment of the invention.

FIG. 9I shows exposure spots 4C(1) formed on the photoconductor when the light emitters in the light emitter row C are turned on at the timing TC0 (time t2). Also shown in FIG. 9I are the exposure spots 4A(10) formed by the light emitter row A and the exposure spots 4B(6) formed by the light emitter row B. The exposure spots 4C(1) are formed next to one of the exposure spots 4A(1), 4A(2), . . . , and 4B(1), 4B(2), . . . , in the direction perpendicular to or substantially perpendicular to the direction Y (first direction).

FIG. 9J shows exposure spots 4A(11) formed on the photoconductor when the light emitters in the light emitter row A are turned on at the timing TA10. Also shown in FIG. 9J are the exposure spots 4B(6) formed by the light emitter row B and the exposure spots 4C(1) formed by the light emitter row C. FIG. 9K shows exposure spots 4B(7) formed on the photoconductor when the light emitters in the light emitter row B are turned on at the timing TB6. FIG. 9L shows exposure spots 4C(2) formed on the photoconductor when the light emitters in the light emitter row C are turned on at the timing TC1.

The positions where the light emitters in the light emitter row C are disposed are shifted from the positions where the light emitters in the light emitter rows A and B are disposed in the axial direction of the photoconductor. Therefore, the exposure spots formed by the light emitters in the light emitter row C in the axial direction of the photoconductor are interleaved between the exposure spots formed by the light emitters in the light emitter row A in the axial direction of the photoconductor and the exposure spots formed by the light emitters in the light emitter row B in the axial direction of the photoconductor. A single linear latent image with a less gap between exposure spots is therefore formed in the axial direction of the photoconductor, whereby the image quality is improved.

Figure 10:
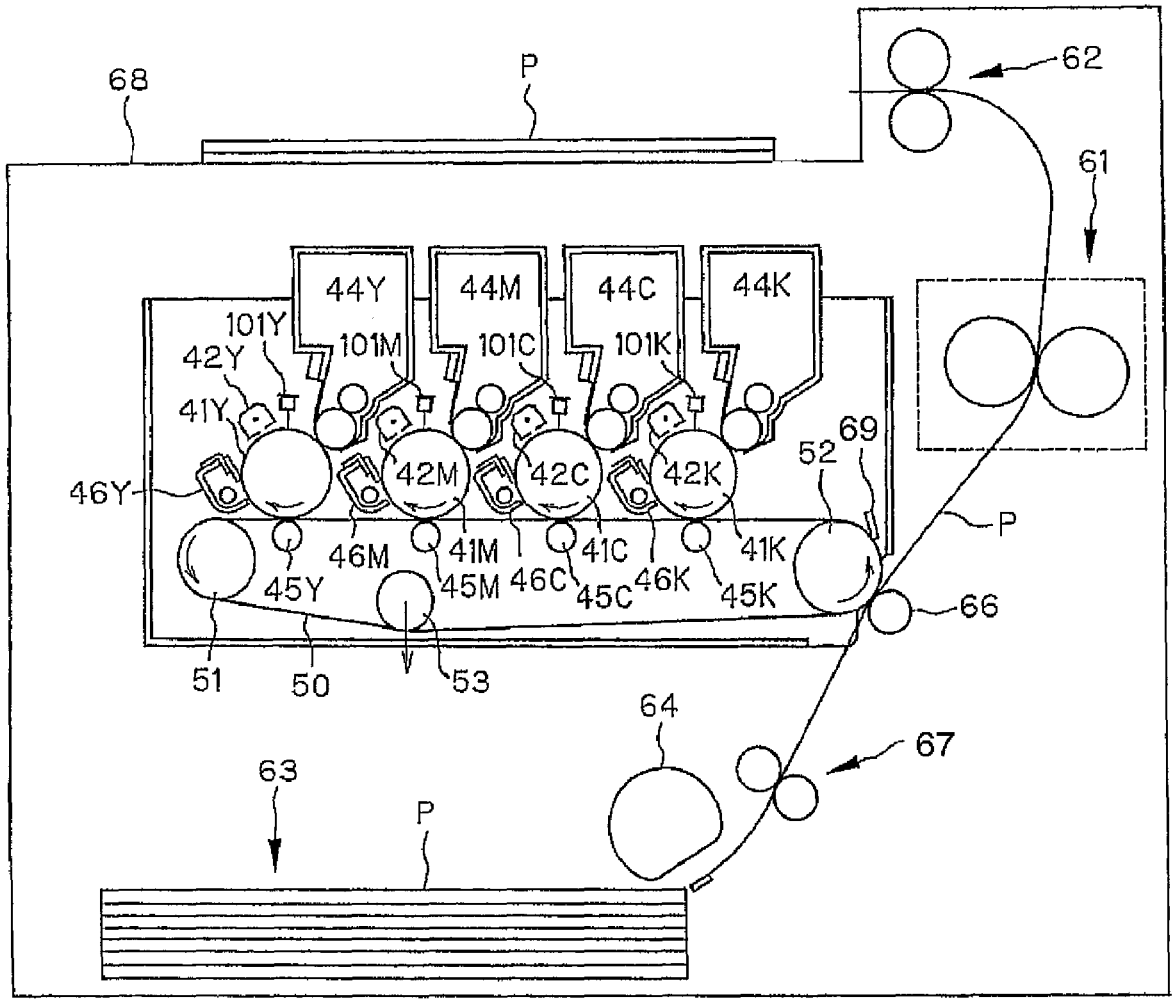
FIG. 10 is a longitudinal cross-sectional side view of an image forming apparatus according to an embodiment of the invention.

The embodiment of the invention is directed to a line head used in a tandem color printer (image forming apparatus) in which four line heads expose four photoconductors to light to simultaneously form four color images, which are transferred onto a single endless intermediate transfer belt (intermediate transfer medium). FIG. 10 is a longitudinal cross-sectional side view showing an example of the tandem image forming apparatus using organic EL devices as light emitters. In the image forming apparatus, four line heads 101K, 101C, 101M, and 111Y having the same configuration are arranged in light exposure positions where corresponding four photoconductors (image carriers) 41K, 41C, 41M, and 41Y having the same configuration are exposed to light.

As shown in FIG. 10, the image forming apparatus includes a drive roller 51, a driven roller 52, and a tension roller 53, as well as an intermediate transfer belt (intermediate transfer medium) 50 that is driven and rotated by the tension roller 53 in the direction indicated by the illustrated arrows (counterclockwise direction). The photoconductors 41K, 41C, 41M, and 41Y are arranged at predetermined intervals in such a way that they face the intermediate transfer belt 50. The letters K, C, M, and Y appended to the reference characters stand for black, cyan, magenta, and yellow, respectively. The photoconductors 41K to 41Y are driven and rotated in the direction indicated by the illustrated arrows (clockwise direction) in synchronization with the drive operation of the intermediate transfer belt 50. Chargers 42 (K, C, M, and Y) and the line heads 101 (K, C, M, and Y) are provided around the photoconductors 41 (K, C, M, and Y).

The image forming apparatus further includes developing devices 44 (K, C, M, and Y) that add toner, which is a developing agent, to electrostatic latent images formed by the line heads 101 (K, C, M, and Y) to convert the electrostatic latent images into visible images, primary transfer rollers 45 (K, C, M, and Y), and cleaning devices 46 (K, C, M, and Y). The line heads 101 (K, C, M, and Y) are configured to emit light whose energy peak wavelengths are in substantial agreement with the sensitivity peak wavelengths of the photoconductors 41 (K, C, M, and Y).

The black, cyan, magenta, and yellow toner images formed by the four single-color toner image forming stations are sequentially transferred onto the intermediate transfer belt 50 in a primary transfer process by a primary transfer bias applied to the primary transfer rollers 45 (K, C, M, and Y). The toner images are sequentially superimposed on the intermediate transfer belt 50 into a full-color toner image. A secondary transfer roller 66 transfers the full-color toner image onto a recording medium P, such as a sheet of paper, in a secondary transfer process. The full-color toner image is fixed on the recording medium P when it passes through a pair of fixing rollers 61, which is a fixing unit. A pair of sheet ejecting rollers 62 eject the recording medium P onto an ejected sheet tray 68 formed in an upper portion of the apparatus.

Reference numeral 63 denotes a sheet feed cassette in which a large number of recording media P are stacked and retained. Reference numeral 64 denotes a pickup roller that feeds recording media P one by one from the sheet feed cassette 63. Reference numeral 67 denotes a pair of gate rollers that define the timing of supplying a recording medium P to a secondary transfer unit comprised of the secondary transfer roller 66. Reference numeral 66 denotes the secondary transfer roller, which carries out the secondary transfer process, the secondary transfer roller 66 and the intermediate transfer belt 50 forming the secondary transfer unit. Reference numeral 69 denotes a cleaning blade that removes toner left on the surface of the intermediate transfer belt 50 after the secondary transfer operation.

In the embodiment of the invention, an LED, an organic EL device, a VCSEL (Vertical Cavity Surface Emitting LASER), or any other similar device can be used as the light emitters in each light emitter array.

While the line head controlling method for correcting an exposure spot shift for each light emitter row to prevent degradation in image quality and the image forming method according to the invention have been described with reference to the above embodiments, the invention is not limited thereto but a variety of changes can be made thereto.

What is claimed is:

1. A method for controlling a line head including a focusing optical system, first light emitters, light from which being focused by the focusing optical system, second light emitters disposed next to the first light emitters in a first direction, light from the second light emitters being focused by the focusing optical system, and third light emitters disposed next to the second light emitters in the first direction, light from the third light emitters being focused by the focusing optical system, the method comprising:

turning on the first light emitters at time t0;

turning on the second light emitters after a period t1 has passed since the time t0; and turning on the third light emitters after a period t2 has passed since the time t0, wherein the periods t1 and t2 are controlled under a following condition: $t2 \neq n \times t1$ (n is an integer two or greater), first latent images formed by the first light emitters at the time t0 on a scanned surface that moves in the first direction, second latent images formed by the second light emitters after the period t1 has passed on the scanned surface that moves in the first direction, and third latent images formed by the third light emitters after the period t2 has passed on the scanned surface that moves in the first direction are formed in a second direction perpendicular to or substantially perpendicular to the first direction, and a distance between the first latent images and the second latent images is a non-integral multiple of a width of any of the first latent images in the second direction.

2. The method for controlling a line head according to claim 1, wherein the distance L1 between the first light emitters and the second light emitters in the first direction, and a distance L2 between the second light emitters and the third light emitters in the first direction satisfy a following equation: $L2 \neq n \times L1$ (n is an integer one or greater).

3. The method for controlling a line head according to claim 1, wherein the focusing optical system has a negative optical magnification.

4. A method for controlling a line head including, a focusing optical system, first light emitters, light from which being focused by the focusing optical system, second light emitters disposed next to the first light emitters in a first direction, light from the second light emitters being focused by the focusing optical system, and third light emitters disposed next to the second light emitters in the first direction, light from the third light emitters being focused by the focusing optical system, the method comprising:

turning on the first light emitters at time t0;

turning on the second light emitters after a period t1 has passed since the time t0; and turning on the third light emitters after a period t2 has passed since the time t0, wherein the periods t1 and t2 are controlled under a following condition: $t2 \neq n \times t1$ (n is an integer two or greater), first latent images formed by the first light emitters at the time t0 on a scanned surface that moves in the first direction, second latent images formed by the second light emitters after the period t1 has passed on the scanned surface that moves in the first direction, and third latent images formed by the third light emitters after the period t2 has passed on the scanned surface that moves in the first direction are formed in a second direction perpendicular to or substantially perpendicular to the first direction, and a distance between the second latent images and the third latent images is a non-integral multiple of a width of any of the first latent images in the second direction.

5. A method for forming an image comprising:

providing a latent image carrier that moves in a first direction;

providing an exposure head including a focusing optical system that is an erect optical system, first light emitters, light from which being focused by the focusing optical system, second light emitters disposed next to the first light emitters in the first direction, light from the second light emitters being focused by the focusing optical system, and third light emitters disposed next to the second light emitters in the first direction, light from the third light emitters being focused by the focusing optical system;

turning on the first light emitters at time t0;

turning on the second light emitters after a period t1 has passed since the time t0; and turning on the third light emitters after a period t2 has passed since the time t0, wherein the periods t1 and t2 are controlled under the following condition: $t2 \neq n \times t1$ (n is an integer two or greater), first latent images formed by the first light emitters at the time t0 on the latent image carrier, second latent images formed by the second light emitters after the period t1 has passed on the latent image carrier, and third latent images formed by the third light emitters after the period t2 has passed on the latent image carrier are formed in a second direction perpendicular to or substantially perpendicular to the first direction, and a distance between the first latent images and the second latent images in the first direction is a non-integral multiple of a width of any of the first latent images formed by the first light emitters on the latent image carrier in the second direction.

6. The method for forming an image according to claim 5, wherein a distance L1 between the first light emitters and the second light emitters in the first direction, and a distance L2 between the second light emitters and the third light emitters in the first direction satisfy a following equation: $L2 \neq n \times L1$ (n is an integer one or greater).

7. A method for forming an image comprising:

providing a latent image carrier that moves in a first direction;

providing an exposure head including a focusing optical system that is an erect optical system, first light emitters, light from which being focused by the focusing optical system, second light emitters disposed next to the first light emitters in the first direction, light from the second light emitters being focused by the focusing optical system, and third light emitters disposed next to the second light emitters in the first direction, light from the third light emitters being focused by the focusing optical system;

turning on the first light emitters at time t0;

turning on the second light emitters after a period t1 has passed since the time t0; and turning on the third light emitters after a period t2 has passed since the time t0, wherein the periods t1 and t2 are controlled under the following condition: $t2 \neq n \times t1$ (n is an integer two or greater), first latent images formed by the first light emitters at the time t0 on the latent image carrier, second latent images formed by the second light emitters after the period t1 has passed on the latent image carrier, and third latent images formed by the third light emitters after the period t2 has passed on the latent image carrier are formed in a second direction perpendicular to or substantially perpendicular to the first direction, and a distance between the second latent images and the third latent images in the first direction is a non-integral multiple of a width of any of the first latent images formed by the first light emitters on the latent image carrier in the second direction.

* * * * *